US007905180B2

(12) United States Patent
Chen

(10) Patent No.: US 7,905,180 B2
(45) Date of Patent: Mar. 15, 2011

(54) LONG RANGE ELECTRIFIED PROJECTILE IMMOBILIZATION SYSTEM

(76) Inventor: Zuoliang Chen, San Francisco, CA (US)

( * ) Notice: Subject to any disclaimer, the term of this patent is extended or adjusted under 35 U.S.C. 154(b) by 1014 days.

(21) Appl. No.: 11/714,959

(22) Filed: Mar. 7, 2007

(65) Prior Publication Data

US 2007/0283834 A1 Dec. 13, 2007

Related U.S. Application Data

(60) Provisional application No. 60/813,063, filed on Jun. 13, 2006.

(51) Int. Cl.
*F41B 15/04* (2006.01)
*F42B 10/16* (2006.01)

(52) U.S. Cl. ..... 102/502; 361/232

(58) Field of Classification Search ..... 102/502; 361/232; 42/1.08; 89/1.11
See application file for complete search history.

(56) References Cited

U.S. PATENT DOCUMENTS

| | | | | |
|---|---|---|---|---|
| 3,834,311 | A | 9/1974 | Mawhinney | |
| 5,473,501 | A | 12/1995 | Claypool | |
| 5,654,867 | A | 8/1997 | Murray | |
| 5,698,815 | A | 12/1997 | Ragner | |
| 5,786,546 | A | 7/1998 | Simson | |
| 5,831,199 | A | 11/1998 | McNulty | |
| 5,962,806 | A | 10/1999 | Coakley | |
| 6,053,088 | A | 4/2000 | McNulty | |
| 6,269,726 | B1 | 8/2001 | McNulty | |
| 6,860,448 | B2 | 3/2005 | Rastegar | |
| 6,997,110 | B2 | 2/2006 | Rastegar | |
| 7,042,696 | B2 | 5/2006 | Smith | |
| 7,327,549 | B2 * | 2/2008 | Smith et al. | 361/232 |
| 2007/0101893 | A1 * | 5/2007 | Shalev et al. | 102/512 |

FOREIGN PATENT DOCUMENTS

EP 0811823 A1 10/1997

* cited by examiner

*Primary Examiner* — James S Bergin

(57) ABSTRACT

A long range electrified projectile immobilization system is mainly comprised of a launching device, a projectile and a high voltage electric pulse current generator. The projectile has two rotary arms which can rotate around hinges on the projectile head at an arc toward the target, there are two pointed electrodes affixed on the rear end of the two rotary arms, these two pointed electrodes are connected to the high voltage electric pulse current generator by two trailing wires. There is also an electric arc sensitive deploying squib inside the projectile and interlock with the two rotary arms, so that these two rotary arms can not separated from each other until the deploying squib is destroyed or removed from the projectile. Once the projectile is launched out by the launching device and hits a target, the deploying squib is initiated by the high voltage electric pulse current, the explosion of the deploying squib will destroy the interlock relation with the two rotary arms and force them rotate around the hinges at an arc toward the target, thus deploy the two pointed electrodes onto the target. The high voltage electric pulse current that conduct through the target from the two electrodes will immobilize the human or animal target.

5 Claims, 17 Drawing Sheets

LONG RANGE ELECTRIFIED PROJECTILE IMMOBILIZATION SYSTEM

Applicant claim priority of Provisional Patent Application No. 60/813,063, Filing Date Jun. 13, 2006.

BACKGROUND

This invention relates generally to the system and methods for launching and deploying an electrified projectile to immobilize a remote human or animal target.

DESCRIPTION OF THE PRIOR ART

Many different kind of electrified projectiles, wireless or wired, have been invented to immobilize a remote human or animal target. In a commonly used conventional electrified projectile immobilization weapon, two sharp electrode darts trailed by two trailing wires are launched toward a target; the trailing wires connect the electrode darts to a high voltage electric pulse current generator. To achieve the needed spread for the two electrode darts, the weapon is designed in such way that the two electrode darts and their trailing wires would continuously spread apart from each other while in flight. This method of establishing the spread of the two electrode darts has a serious drawback, it greatly limits both minimum and maximum range of the weapon. If the electrode darts hit a target within 2.8 feet from the launcher, the stun weapon would not likely be effective in disabling the target, because the minimum effective spread between the electrode darts would not yet have been achieved. At a distance of 15 feet from the launcher, the electrode darts are spread approximately 3 feet apart and would not likely both hit a human or small animal target to complete the circuit. Also the effective range of the weapon is limited by the length of the trailing wires. Because the electrode dart is very small and light weight, it is not likely to carry a long wire and still accurately hit and have enough force to embed in a far away target. In order to cut off the trailing wires, many wireless methods have been invented. One wireless method is to pack the whole circuit, including the power source, inside a projectile and launch it toward the target. This however will made the projectile very big and heavy, and therefore, has to be launched from a large launcher. This also makes the projectile a lethal weapon at short range. Also, how to achieve the effective spread of the two electrodes is another problem. Another wireless method is to use a high energy laser beam to generate a plasma electric path to conduct the electric energy to the target. But this method requires a very large power source, complicated and expensive equipments, and thus makes the weapon very heavy and not portable.

U.S. Pat. No. 5,831,199 to McNulty, James on May 29, 1997 discloses a longer range, single projectile stun weapon, it launches a single projectile towards a target and a second projectile is launched from the first projectile when the first projectile hits or near the target. One of the methods to expel the second projectile at or near the target is to use the electric arc that completed through the target to ignite a pyrotechnic device to launch the second projectile from its bore. However, this method is not reliable. This invention also has the following disadvantages:

(1) The projectile and the cartridge made from such a projectile are too big and heavy, and can not be fitted into a small portable stun weapon;
(2) Technically difficult and expensive to make;
(3) If the first projectile hits the edge of a target, the second projectile may miss the target.

U.S. Pat. No. 7,042,696 to Smith on May 9, 2006 discloses another type of longer range, single projectile stun weapon which launches a single projectile toward a target, in which after the first electrode or first portion hits the target, a second electrode or a second portion is released and deployed from the projectile to hit the target. In order to deploy the second electrodes or second portion, the invention uses a translating element that slides inside the projectile to force a plug or a break-away tab to separate from a casing and fly away from the projectile body on impact of projectile with the target. This will activate the second electrode or second portion for deploying. The second electrode or second portion is then deployed to the target by force of spring. This invention has the following disadvantages:

(1) For the translating element to reliably force a plug to separate from the casing, the translating element must be heavy enough and slide a long path inside the projectile to gain enough momentum force to break a tab; this will substantially increase the length and weight of the projectile. A big and heavy projectile is not a good option for non-lethal weapon.
(2) Experiments have shown that for an electrode to penetrate clothing and skin, substantial force and speed is needed. A small spring can not generate enough force to deploy the second electrode or second portion onto a target; a larger spring would make the projectile too big and heavy for practical application.
(3) Another problem is that because an electrified projectile usually carries or generates very high voltage electric pulse currents, very limited metal parts should be used in the projectile. Otherwise the high voltage electric current will complete through these metal parts instead of the target, make the projectile ineffective.

To make a long range electrified projectile which can be launched from a small portable launcher and be effective, the projectile must be small and light weight enough to remain non-lethal at short range and the two electrodes must be deployed to the target at a desired spread effectively. A good method to deploy the electrodes onto the target is to use explosive material such as explosive powder. A small explosive squib can generate sufficient force at very short time, but how and when to initiate this explosive squib is very crucial. If it is initiated too early, the electrodes will be deployed in the air during the flight and can not be deployed to the target. If it is initiated too late after the projectile hits the target, the projectile may be hanging down on the cloth by its own weight, and the electrodes may not be effectively deployed onto the target. The best time to initiate the explosive squib is right at the moment the projectile hit the target.

Advantages

A workable prototype of the present invention has been successfully made and launched from a small portable launcher to hit a target 35 feet away accurately, and the two electrodes are successfully deployed onto the target at a spread of 5". This working prototype has a diameter of only 12 mm, 65 mm in length and weight only 8 gm.

Accordingly, the advantages of the present invention are:

(1) Having much longer effective range and much higher accuracy than conventional stun weapon, its range is only limited by the length of trailing wires;
(2) Small in size, simple in structure and inexpensive to make;
(3) Electrodes can be deployed to the target once the projectile hit the target;
(4) Can be launched from a small hand-held launcher;

(5) Small and light enough to be integrated with any conventional lethal weapons, adding non-lethal function to lethal weapons.

Further objects and advantages are to provide a long range electrified projectile immobilization system which having much longer effective range and much higher accuracy than conventional stun weapon, and is small in size, inexpensive to make and portable. Further objects and advantages will become apparent from a consideration of the ensuing description and drawings.

Objects

It is therefore a principal object of the invention to provide a system and methods for launching and deploying an electrified projectile to immobilize a remote human or animal target with a much longer effective range, much higher accuracy than the conventional stun weapon, and is small in size, and inexpensive to produce.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

REFERENCE NUMERALS IN DRAWINGS

Figure 1:
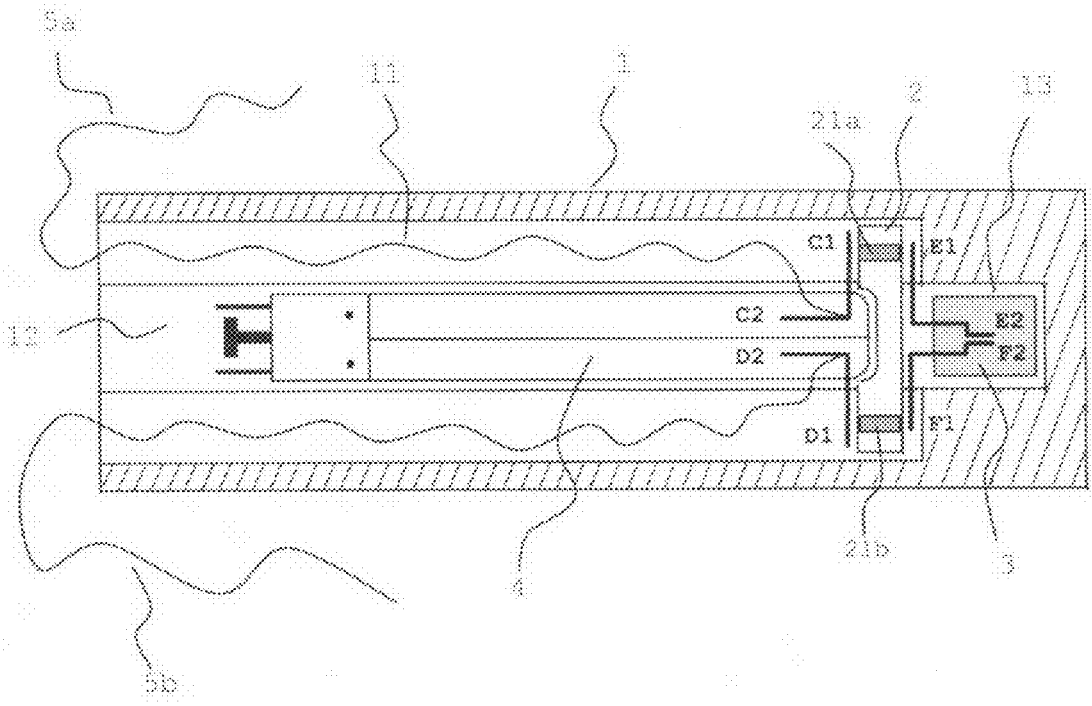
FIG. 1 illustrates the cross section side view of a barrel with a projectile, a launching block and a launching squib loaded in it.
Figure 2A:
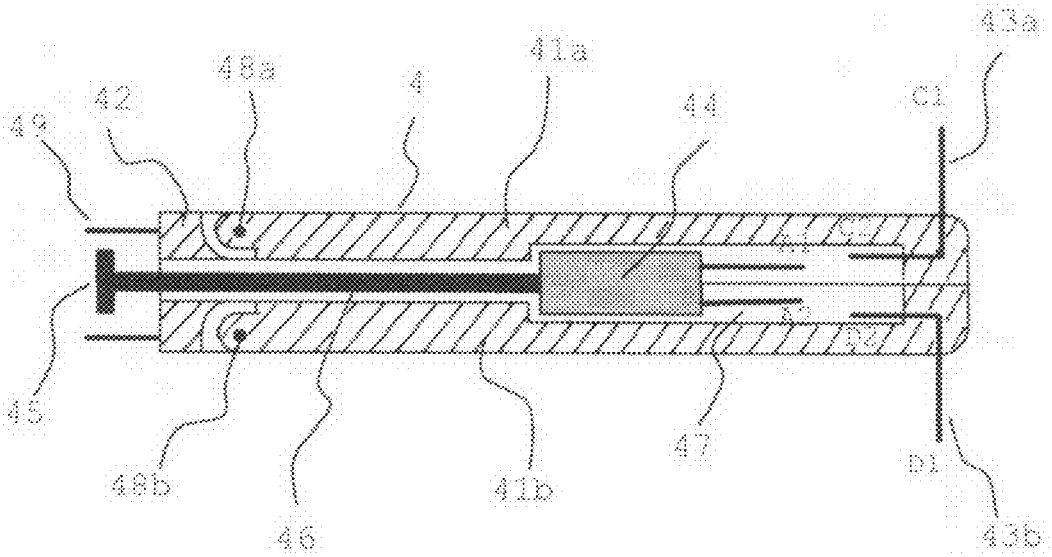
FIG. 2A illustrates the cross section side view of a projectile.
Figure 2B:
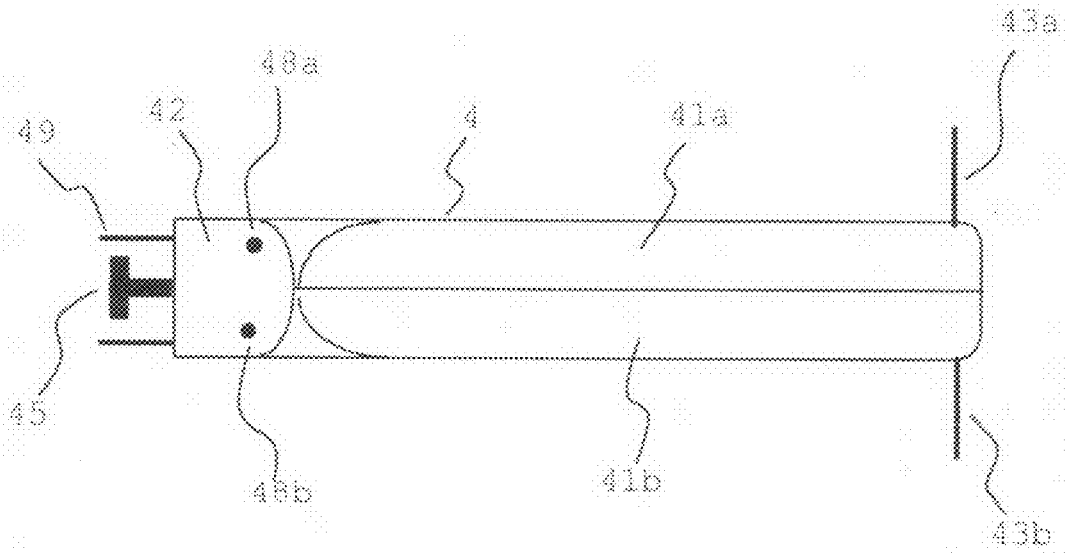
FIG. 2B illustrates the side view of a projectile.
Figure 2C:
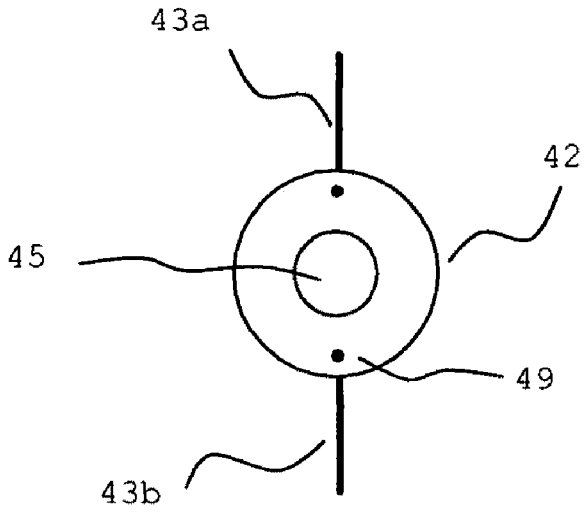
FIG. 2C illustrates the front view of a projectile.
Figure 2D:
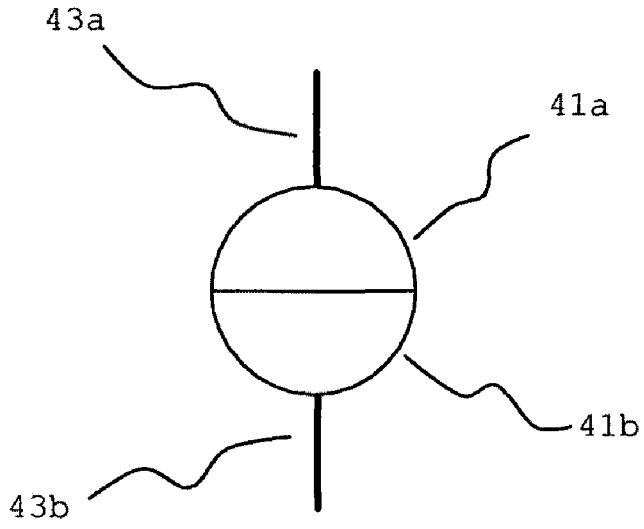
FIG. 2D illustrates the rear view of a projectile.

1 barrel
11 electrode groove
12 bore
13 launching chamber
2 launching block
21*a* conductor a
21*b* conductor b
3 launching squib
4 projectile
41*a* rotary arm a
41*b* rotary arm b
42 projectile head
43 pointed electrode
43*a* pointed electrode a
43*b* pointed electrode b
44 deploying squib
45 detonating rod
46 detonating hole
46*a* detonating groove on rotary arm a
46*b* detonating groove on rotary arm b
47 exploding chamber
47*a* exploding hole on rotary arm a
47*b* exploding hole on rotary arm b
471*a*, 472*a* grooves on exploding hole 47*a*
471*b*, 472*b* grooves on exploding hole 47*b*
441, 442, 443, 444 projections on deploying squib
445 deploying squib tail
48*a* hinge a
48*b* hinge b
49 barbs or needles
5*a* trailing wire a
5*b* trailing wire b
6*a* elastic string a
6*b* elastic string b
7 high voltage electric pulse current generator
71 coupling hole
72 muzzle extension
7*a*, 7*b* the two output terminals of high voltage electric pulse current generator
8 cartridge
81 coupling block

82 locking tab
8*a*, 8*b* the two cartridge input terminals
10 stun weapon
100 target
A deploying squib conducting wire A
A1 wire A outside terminal
A2 wire A inside terminal
B deploying squib conducting wire B
B1 wire B outside terminal
B2 wire B inside terminal
C1 electrode 43*a* outside terminal
C2 electrode 43*a* inside terminal
D1 electrode 43*b* outside terminal
D2 electrode 43*b* inside terminal
E launching squib conducting wire E
E1 wire E outside terminal
E2 wire E inside terminal
F launching squib conducting wire F
F1 wire F outside terminal
F2 wire F inside terminal

DETAILED DESCRIPTION OF PREFERRED EMBODIMENTS

The present invention fully uses the following special features of high voltage electric pulse currents used in stun weapons to immobilize a human or animal target:

1. A high voltage electric pulse current has the ability to arc (jump) through air between two conducting terminals to complete a circuit. When it jumps from one terminal to another, electric arcs are generated between these two terminals. The higher the peak voltage of the pulse current, the longer the distance it can arcs through the air. For example, a pulse current having a peak voltage of 30,000 volts can arcs through an air gap of about 1 inch to complete the circuit; a pulse current having a peak voltage of 50,000 volts can arcs through an air gap of about 1.65 inches to complete the circuit.
2. A high voltage electric pulse current always finds the least resistant path to complete the circuit. That means when it arcs through the air, it will always find the shortest air path to complete the circuit.

A typical embodiment of the present invention is illustrated in FIG. 1, the system is mainly consisting of a barrel 1, a projectile 4, a launching block 2, a launching squib 3, a pair of trailing wires 5*a*, 5*b* and a high voltage electric pulse current generator 7 (not shown).

Figure 7A:
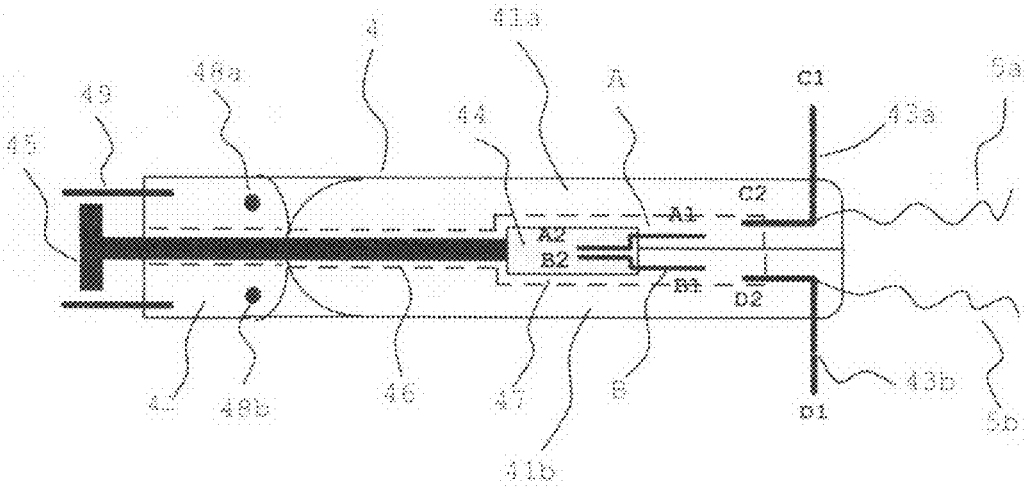
FIG. 7A illustrates the condition of a projectile in flight.
Figure 7B:
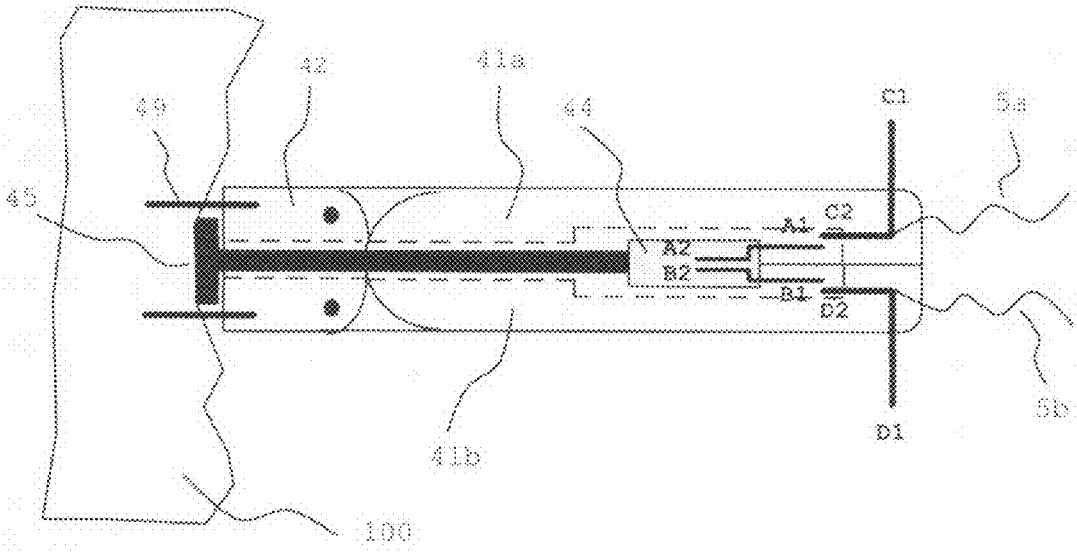
FIG. 7B illustrates the condition of a projectile which just hit the target but the deploying squib not yet initiated.

As illustrated in FIG. 2A, FIG. 2B, FIG. 2C, FIG. 2D, FIG. 3A, FIG. 3B, FIG. 3C, FIG. 3D and FIG. 3E, a projectile 4 is mainly constructed of a head 42 having a through hole in the middle, two rotary arms 41*a* and 41*b* (the two rotary arms 41*a* and 41*b* are identical in size and structure and refer as rotary arm 41, so only 41*a* is described here). Rotary arm 41*a* is preferably made in the shape of a half cylinder, there is an exploding hole 47*a* locate in the middle to rear portion of the arm, there is a longitudinal detonating groove 46*a* locate in the middle of rotary arm 41*a*, with one end opening in exploding hole 47*a*, and the other end opening in the front end of rotary arm 41*a*. So, when rotary arm 41*a* closed up with rotary arm 41*b*, a long round projectile 4 is formed, an exploding chamber 47 is formed from the two exploding holes 47*a* and 47*b*, and a detonating hole 46 is formed from the through hole in projectile head 42 and the two grooves 46*a* and 46*b*. Rotary arms 41 should be mainly made from non conductive material like high strength plastic to prevent the high voltage electric pulse current to conduct through them, and should be strong enough to withstand the strong exploding force from the explosion of a deploying squib 44. The length of the rotary arms will determine the spread of the two electrodes which deployed onto the target, for example, if the length of the rotary arm is 2½", we may achieve a spread of about 5". A projectile 4 is further constructed of a deploying squib 44 which is sensitive to electric arcs, a detonating rod 45, and a plurality of barbs or needle 49 mounted on the front face of the projectile for attaching the projectile to the target, and two pointed electrodes 43*a* and 43*b*. The two pointed electrodes 43*a* and 43*b* are affixed to the rear end of rotary arms 41*a* and 41*b*, with the pointed portion in an upright position to the rotary arms 41*a* and 41*b*, and another portion inside the rotary arms with their terminals C2 and D2 electrically exposed to exploding chamber 47. Trailing wire 5*a* is used to electrically connect electrode 43*a* to one output terminal of the high voltage electric pulse current generator 7, trailing wire 5*b* is used to electrically connect electrode 43*b* to the other output terminal of the high voltage electric pulse current generator 7 (not shown), as illustrated in FIG. 7A and FIG. 7B.

Figure 5A:
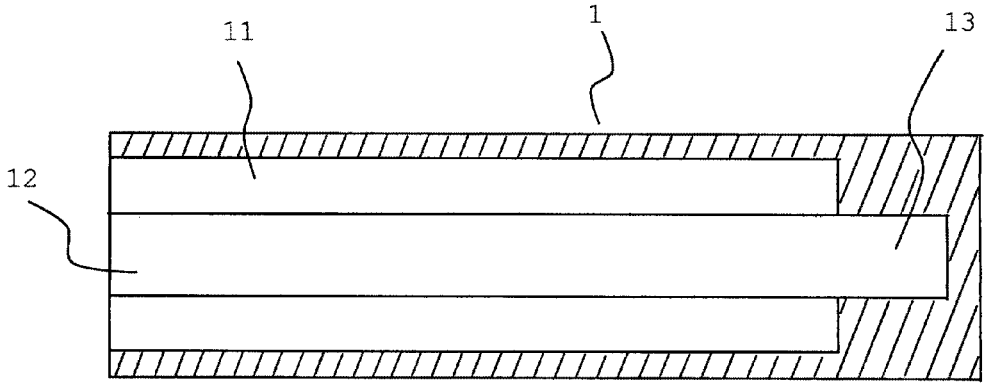
FIG. 5A illustrates the cross section side view of a barrel.
Figure 5B:
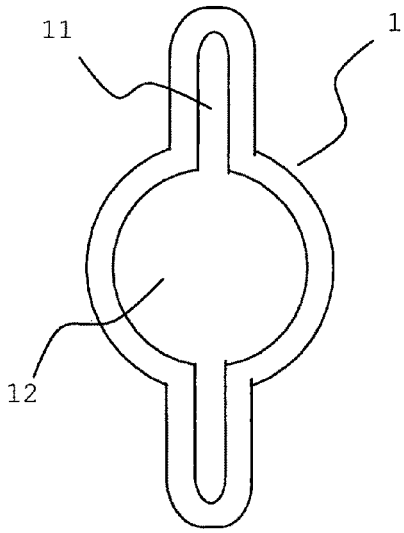
FIG. 5B illustrates the front view of a barrel.
Figure 5C:
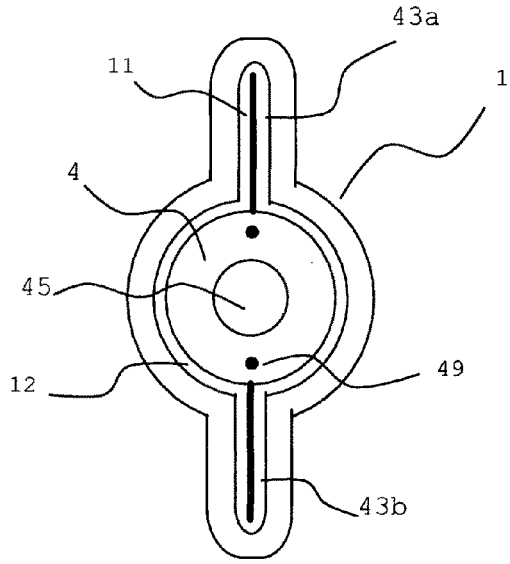
FIG. 5C illustrates the front view of a barrel with a projectile loaded in it.

As illustrated in FIG. 5A, FIG. 5B and FIG. 5C, barrel 1 is preferably made from non-conductive material like high strength plastic, there is a longitudinal bore 12 located in the middle portion of the barrel, with the breech closed, there are two longitudinal electrode grooves 11 located on the top and bottom of barrel 1 to accommodate the two electrodes 43*a* and 43*b* on the projectile, the length of the two grooves 11 are about half inch shorter than the bore 12, and having the same opening end as the bore 12, so a launching chamber is formed in the breech of the barrel. The reason to make the barrel in such a unique structure is the need to accommodate the two electrodes 43*a* and 43*b* on projectile 4. If we use a round barrel to launch the projectile, the two electrodes 43*a* and 43*b* must be folded up with the projectile before the projectile leaving the barrel, and must be erected to an upright position to the projectile after the projectile leave the barrel, this function will mechanically make the projectile structure very complicated and difficult to make. By simply affix the two electrodes 43*a* and 43*b* onto the projectile and leave two grooves on the barrel for them to move away from the barrel can easily solve the problem, although some launching power will be lost in the launching stage, this lost can be substantially reduced by using an launching block 2 as described later.

Figure 6A:
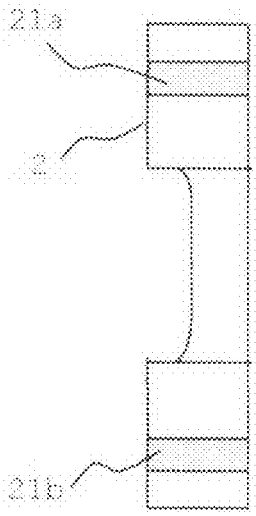
FIG. 6A illustrates the side view of a launching block.
Figure 6B:
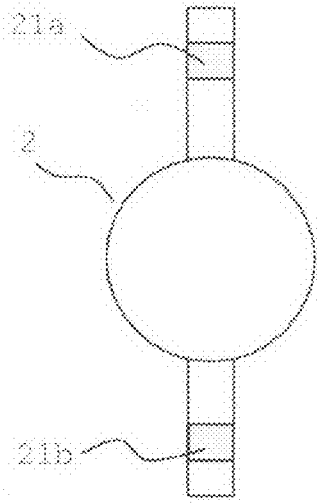
FIG. 6B illustrates the front view of a launching block.
Figure 6C:
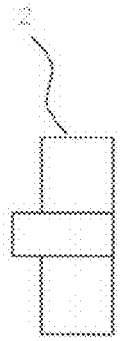
FIG. 6C illustrates the top view of a launching block.

A launching block 2 is an important element in the system, as shown in FIG. 6A, FIG. 6B and FIG. 6C, it has a round middle part, a top projection located on the top of the middle part, and a bottom projection located on the bottom of the middle part, the middle part is made to barely fit into bore 12, and the two projections are made to barely fit into the two grooves 11, so that launching block 2 can slide along the length of barrel 1. The launching block should be made from non conductive, high strength material like high strength plastic, there are two conductors 21*a* and 21*b* locate on the two projections to conduct high voltage electric pulse current from the pointed electrodes 43*a* and 43*b* to launching squib 3.

A launching block 2 mainly performs the following functions:

1. To protect the two electrodes 43*a* and 43*b* from bended down by the launching force. If there was no launching block 2 placed between projectile 4 an launching squib 3, when launching squib 3 is initiated, the sudden launching force will be directly applied to the two electrodes 43*a* and 43*b*, causing the two electrodes 43*a* and 43*b* to be bended down, making them to be unable deployed onto the target.

2. To reduce the lost of launching power from electrode grooves 11;

3. To conduct electric pulse current from electrodes 43*a* and 43*b* to launching squib 3 wire terminals E1 and F1 in the launching stage via conductors 21*a* and 21*b*.

Figure 6D:
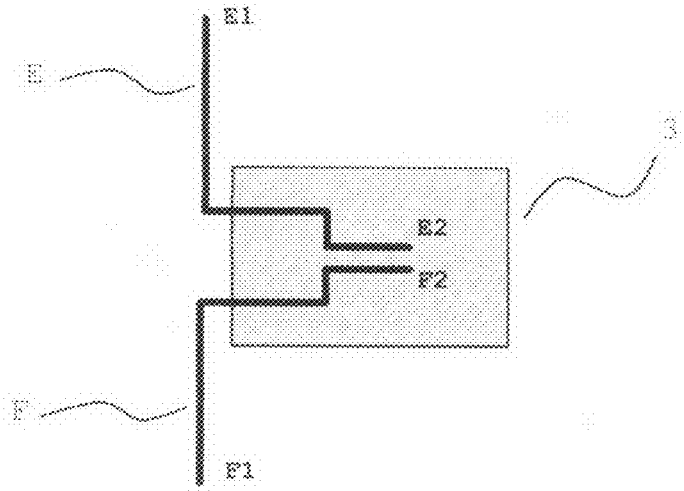
FIG. 6D illustrates a launching squib.

As illustrate in FIG. 6D, a launching squib 3 is preferably made from electric arc sensitive powder and certain amount of launching powder, it has two insulated conducting wires E and F, the four terminals E1, E2, F1, F2 are not insulated, there is a big gap between terminal E1 and F1 and a small gap between terminal E2 and F2, electric arc sensitive powder is placed between and around E2 and F2, so when high voltage electric pulse current is completed from path E1-E2-F2-F1, electric arcs are generated between E2 and F2, and the electric arc sensitive powder is initiated and the launching squib is detonated.

Figure 3A:
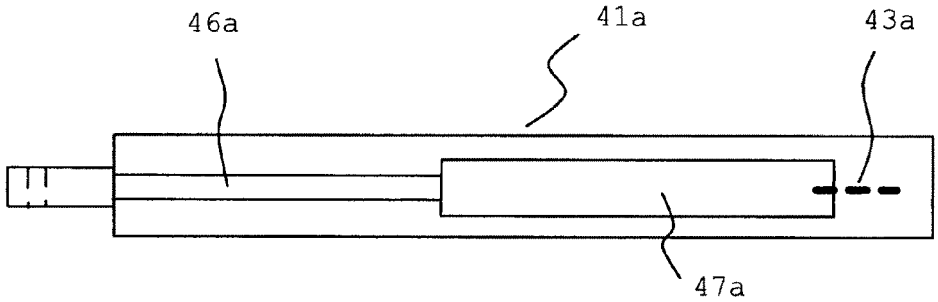
FIG. 3A illustrates the bottom view of a rotary arm 41*a;*
Figure 3B:
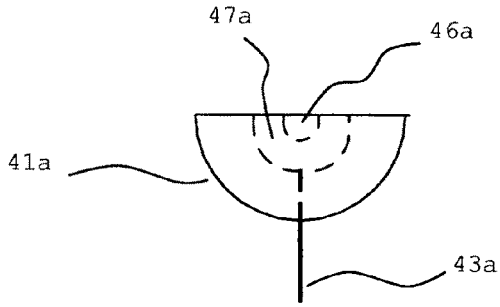
FIG. 3B illustrates the rear view of a rotary arm 41*a;*
Figure 3C:
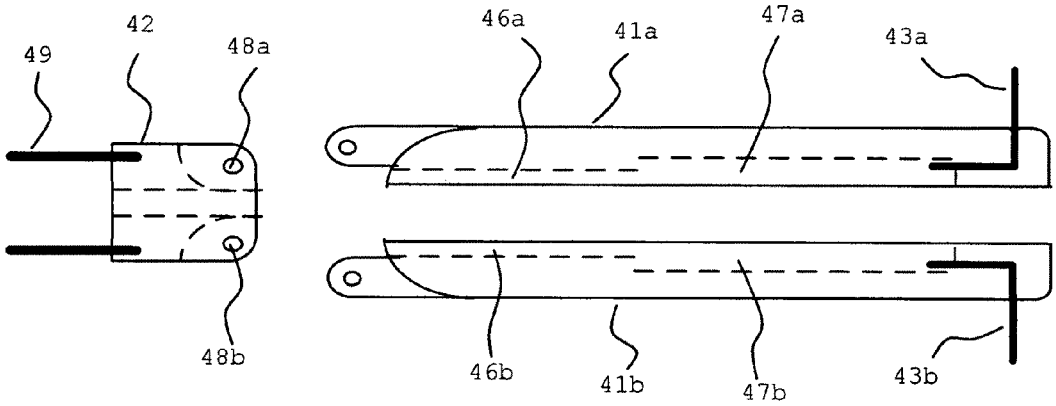
FIG. 3C illustrates the side view of a projectile head and two rotary arms.
Figure 3D:
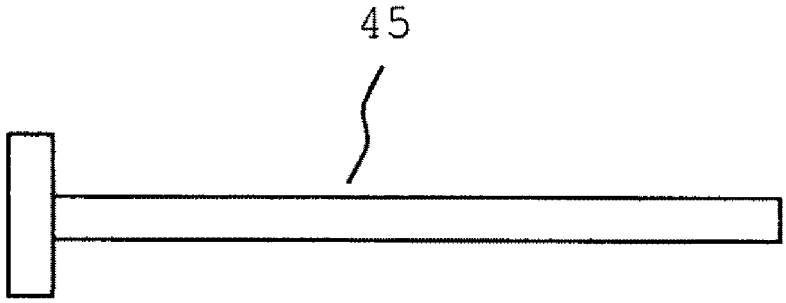
FIG. 3D illustrates a detonating rod.
Figure 3E:
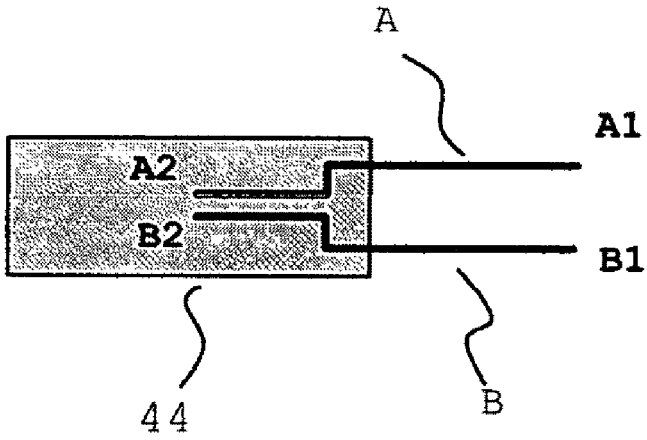
FIG. 3E illustrates a deploying squib.
Figure 4A:
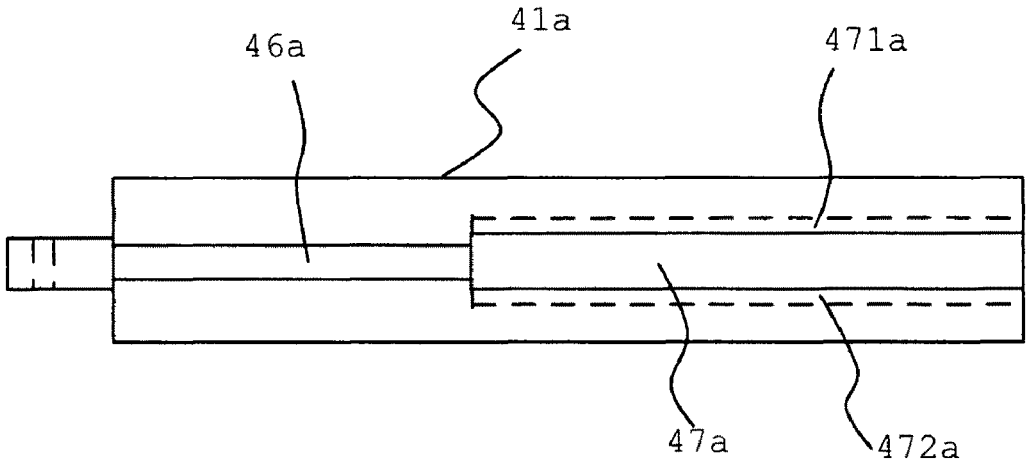
FIG. 4A illustrates the bottom view of a rotary arm 41*a* having an exploding hole with grooves.
Figure 4B:
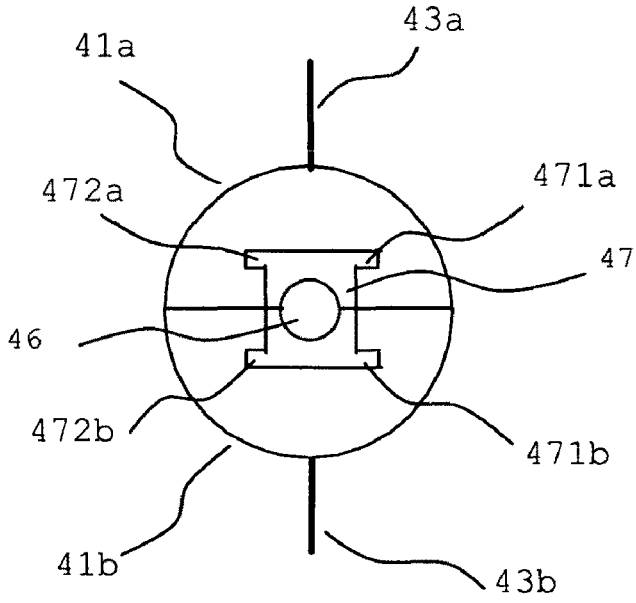
FIG. 4B illustrates the rear view of a projectile having an exploding hole with grooves.
Figure 4C:
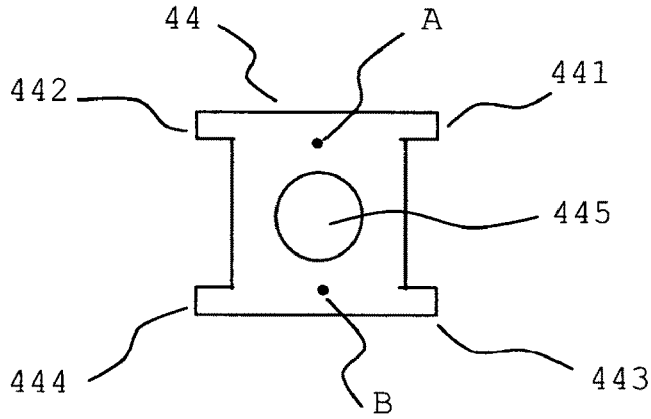
FIG. 4C illustrates the rear view of a deploying squib having four projections and a tail.
Figure 4D:
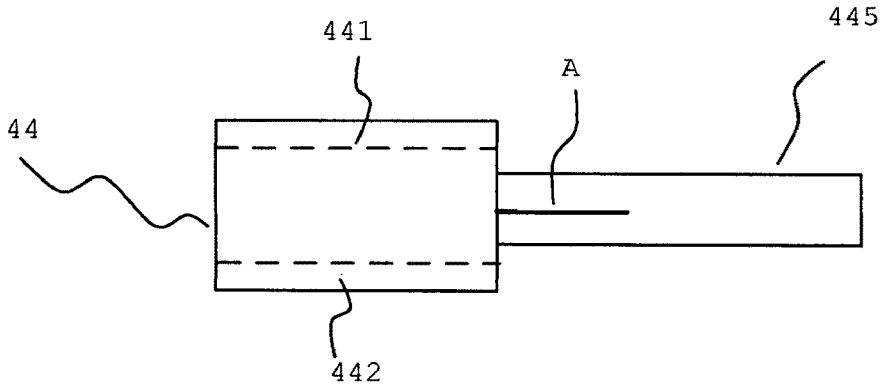
FIG. 4D illustrates the top view of a deploying squib having four projections and a tail.
Figure 4E:
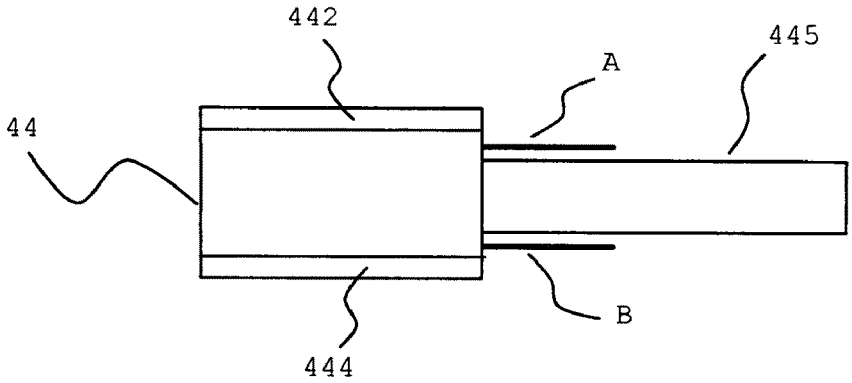
FIG. 4E illustrates the side view of a deploying squib having four projections and a tail.

As illustrated in FIG. 3E, a deploying squib 44 is preferably made from electric arc sensitive powder and certain amount of exploding powder, it has two insulated conducting wires A and B, the four terminals A1, A2, B1, B2 are not insulated, there is a big gap between terminal A1 and B1 and a small gap between terminal A2 and B2, electric arc sensitive powder is placed between and around A2 and B2, so when high voltage electric current completed from path A1-A2-B2-B1, electric arcs are generated between A2 and B2, and the electric arc sensitive powder is initiated and the deploying squib is detonated.

The method of assembling a projectile 4 is illustrated in FIG. 3C and FIG. 7A. To assemble a projectile 4, rotary arms 41*a* and 41*b* are attached to projectile head 42 using hinges 48*a* and 48*b*, a detonating rod 45 is placed in the detonating hole 46, with its front end outside the front end of head 42, and its rear end inside exploding chamber 47, detonating rod 45 is placed in such way that when no force is applied to its front end, it is not movable, but when sufficient force is applied to its front end, it can be force to move backward toward the rear of the projectile. Deploying squib 44 is placed inside exploding chamber 47, with the rear end which having conducting wires A and B facing the rear of projectile 4, and the front end is affixed to or in close contact with the rear end of detonating rod 45. Deploying squib 44 is made and placed in such way that the length of A1C2 plus A2B2 plus B1D2 is greater than the length of C2D2, so under this normal condition, when a high voltage electric pulse current is applied to pointed electrodes 43*a* and 43*b*, the high voltage electric pulse current will complete through path C2-D2 instead of through path C2-A1-A2-B2-B1-D2. Rotary arms 41*a* and 41*b* are movably closed up together, such that under normal condition they remain closed up, but when sufficient force is generated from inside the projectile, they can be separated from each other and turning at an arc around hinges 48*a* and 48*b* toward the target.

However, in actual practice, for the whole system to operate successfully, three main problems must be solved:

1. The two rotary arms must be closed up to each other before the deploying squib is initiated, and they must be able to be separated from each after the deploying squib is initiated. The problem is that when the projectile hits the target and stop, the stopping momentum force will force the two rotary arms to be separated from each other before the deploying squib is initiated. To keep the two rotary arms remain closed up each other, one common method is to use the friction force of the rotary arms with the hinges. This has proven not work. Because the momentum force is so strong, it will easily overcome the friction force. Also, too much friction force with the hinges will slow down the rotating speed of the two rotary arms, making them ineffective in deploying the electrodes onto the target. Another common method is to use a breakable tab or mechanical lock to lock up the two rotary arms before the projectile hits the target and use the stopping momentum force to break the tab or to remove the mechanical lock when the projectile hit the target. This method will increase the complexity of the structure, and will require the timing of breaking the tab or releasing the lock to be exactly the moment before the deploying squib is initiated, because the electric response time is much shorter than mechanical response time, this perfect timing is not easily achieved.

2. The deploying squib can not be moved backward before the projectile hits the target; otherwise it will be initiated shortly after the projectile is launched. The problem is that the deploying squib is enclosed inside the projectile and not affixed to the projectile, when the projectile is launched and accelerating in the barrel, the sudden acceleration of the projectile will cause the deploying squib to move backward toward the rear of the projectile, causing it to be initiated shortly after the projectile is launched. This backward movement of the deploying squib must be removed.

3. The trailing wire must be connected to the projectile all the time. The problem is that when the projectile hits the target and stops, due to the momentum, the wires in the air still travel toward the target at high speed and generate a pulling force to the other end of the trailing wires. When the wires in the air are long and heavy enough, this pulling force will be strong enough to break the trailing wires.

The first two problems can be solved by redesigning the structure of the two rotary arms 41 and deploying squib 44, as shown in FIG. 4A, FIG. 4B, FIG. 4C, FIG. 4D and FIG. 4E, exploding hole 47*a* and 47*b* are open all the way the rear end of the rotary arms, on the side of exploding hole 47*a*, there are two grooves 471*a* and 472*a*, on the side of exploding hole 47*b*, there are two grooves 471*b* and 472*b*. Deploying squib 44 is made in such way that it has four projections 441, 442, 443, 444 locate on the top and bottom edges, the cross section size and shape of the deploying squib should match the cross section size and shape of exploding chamber 47, such that deploying squib 44 can slide inside exploding chamber 47.

On the rear end of deploying squib 44, there is a tail 445, when deploying squib 44 is loaded inside projectile 4; tail 445 extends all the way to the rear opening of the projectile, with its rear end level to the rear end of the projectile. So, when the projectile is launched, the launching force will apply to the rear of the projectile and the rear end of the deploying squib tail 445 simultaneously. Thus, the deploying squib will have the same acceleration as the projectile has and the relative position of the exploding squib to the projectile will remain unchanged before the projectile hits the target. And therefore the deploying squib will not be initiated during the launching and flying to the target.

Figure 8:
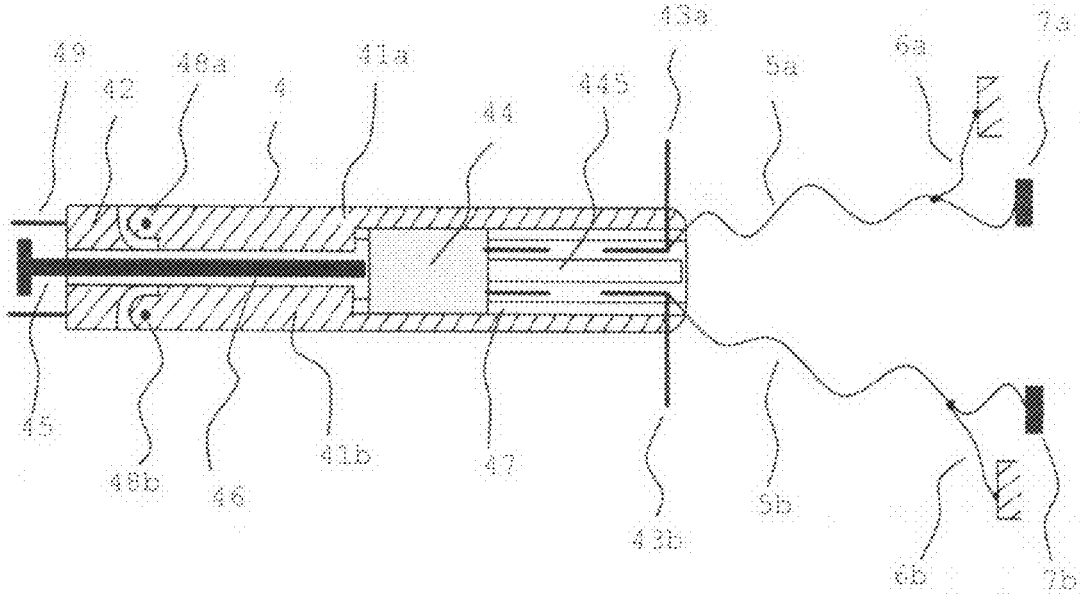
FIG. 8 illustrates a projectile with rotary arms interlock with a deploying squib.

To assemble such a projectile 4, as shown in FIG. 8, first close up the two rotary arms 41*a* and 41*b*, then load deploying squib 44 inside the projectile from the rear end opening of the projectile, with the four projections 441, 442, 443, 444 slide into the four grooves 471*a*, 472*a*, 471*b*, 472*b* accordingly, the rear end of deploying squib tail 445 extend to the rear opening of projectile 4, and is level to the rear end of the projectile, so the deploying squib will interlock with the two rotary arms from the inside through the relations of the four projections with the four grooves. Before the deploying squib is initiated and explodes, the interlocking relation remains unchanged. Once the deploying squib 44 is initiated and explodes, the whole deploying squib is destroyed into small pieces, and the interlocking with the rotary arms is destroyed. Thus the two rotary arms 41*a* and 41*b* are released to rotate around hinges 48*a* and 48*b* at an arc.

To prevent the trailing wires to be broken, a piece of elastic string can be tied to the end of each trailing wires, with one end of the elastic string tied to the trailing wire, the other end tied to a fixed point in the stun weapon cartridge which holds the trailing wires. Thus the pulling force generated by the momentum of the trailing wire in the air can be absorbed by the elastic strings.

Figure 9:
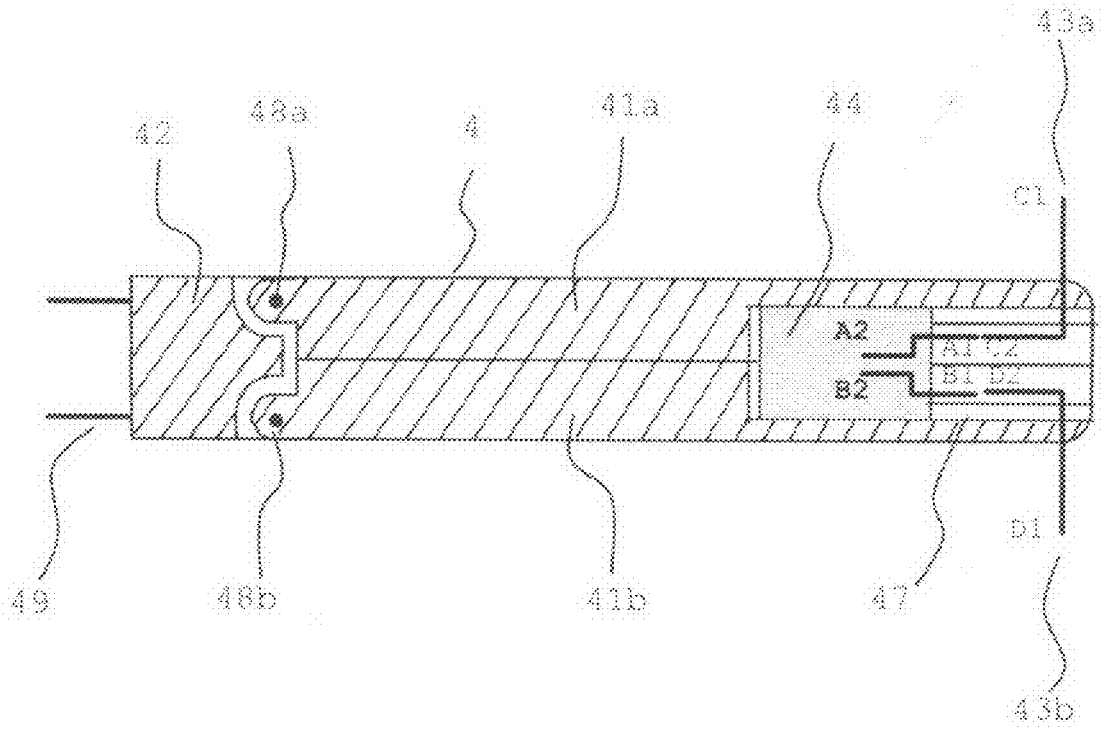
FIG. 9 illustrates a delay initiated projectile with rotary arms interlock with A deploying squib.

In another embodiment, instead of using a detonating rod to initiate the deploying squib, some kind of delay electric circuit can be used to initiate the deploying squib. The advantage of this method is that the structure of the projectile is simpler and the projectile can be launched by any other means. The disadvantage is that the deploying squib is not initiated right at the moment when the projectile hit the target, and the electric circuit will be more complicated. A projectile assembled in this method is illustrated in FIG. 9, in which a deploying squib with four projections is rear loaded inside the projectile and interlock with the rotary arms, and is made unmovable inside the projectile, it is placed in such way that terminals A1 and B1 are very close to C2, D2, so that when high voltage electric pulse current is apply to electrode 43*a* and 43*b*, the pulse current will complete through path C2-A1-A2-B2-B1-D2, and electric arcs will be generated between A2 and B2 to initiate deploying squib 44.

Many methods can be used to delay initiate the deploying squib. One method is to use a high voltage electric pulse current generator which can generate a single pulse when it is initiated. This pulse will initiate the launching squib, after a certain delay time (the time required to hit the most far away target the projectile can hit), a series of pulses are generated to initiate the deploying squib and immobilize the target.

Another method is to use two separate circuits, one circuit used to initiate the launching squib to launch the projectile, and another circuit used to generate a high voltage electric pulse current at a certain delay to initiate the deploying squib and immobilize the target.

Of course, the projectile can be launched by many other means like compressed air, spring, etc., and a high voltage electric pulse current is generated at a certain delay to initiate the deploying squib and immobilize the target.

In another embodiment, the high voltage electric pulse current generator can be housed inside the projectile to make a wireless projectile system.

Yet in another embodiment, the present electrified projectile system can be integrated with a conventional lethal weapon such as a hand gun, a riffle, etc. to add non-lethal features to a lethal weapon by mounting this system on the lethal weapon. So the operator of the weapon can have the options to either fire a non-lethal projectile or fire a lethal projectile at any time.

In actual practice, for easy application, barrel 1, projectile 4, trailing wires 5*a* and 5*b* are housed in a cartridge 8, and high voltage pulse current generator 7 is housed in a stun weapon 10, cartridge 8 has to be coupled to the muzzle of stun weapon 10 before it can be used.

Figure 10A:
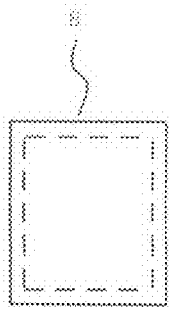
FIG. 10A illustrates the front view of a regular cartridge.
Figure 10B:
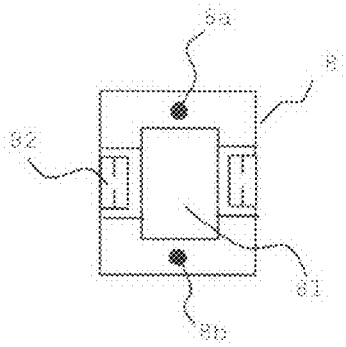
FIG. 10B illustrates the rear view of a regular cartridge.
Figure 10C:
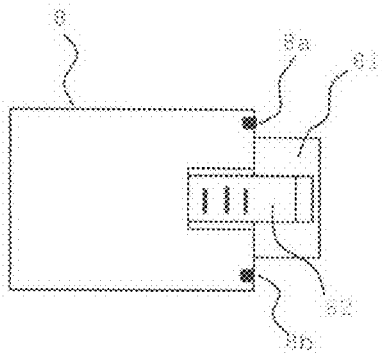
FIG. 10C illustrates the side view of a regular cartridge.
Figure 10D:
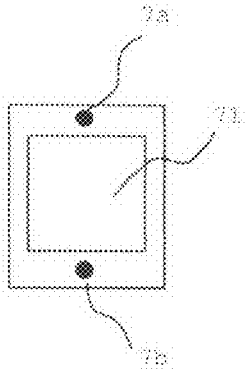
FIG. 10D illustrates the front view of a regular stun weapon muzzle.
Figure 10E:
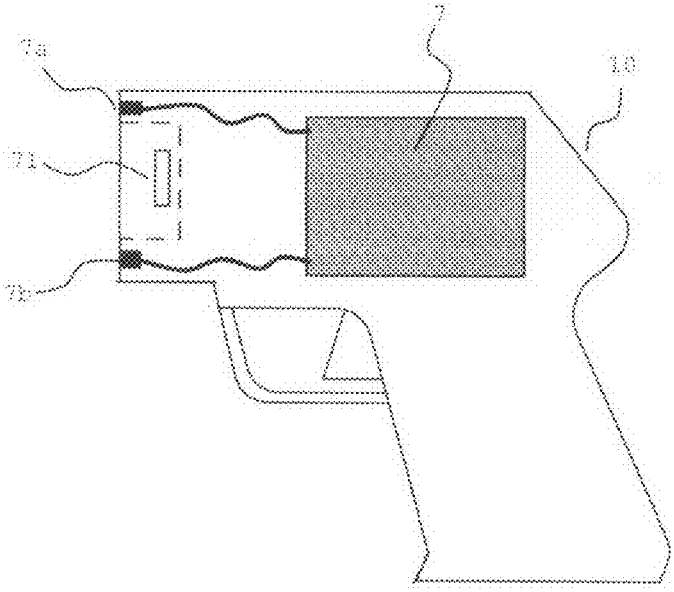
FIG. 10E illustrates the side view of a regular stun weapon.
Figure 10F:
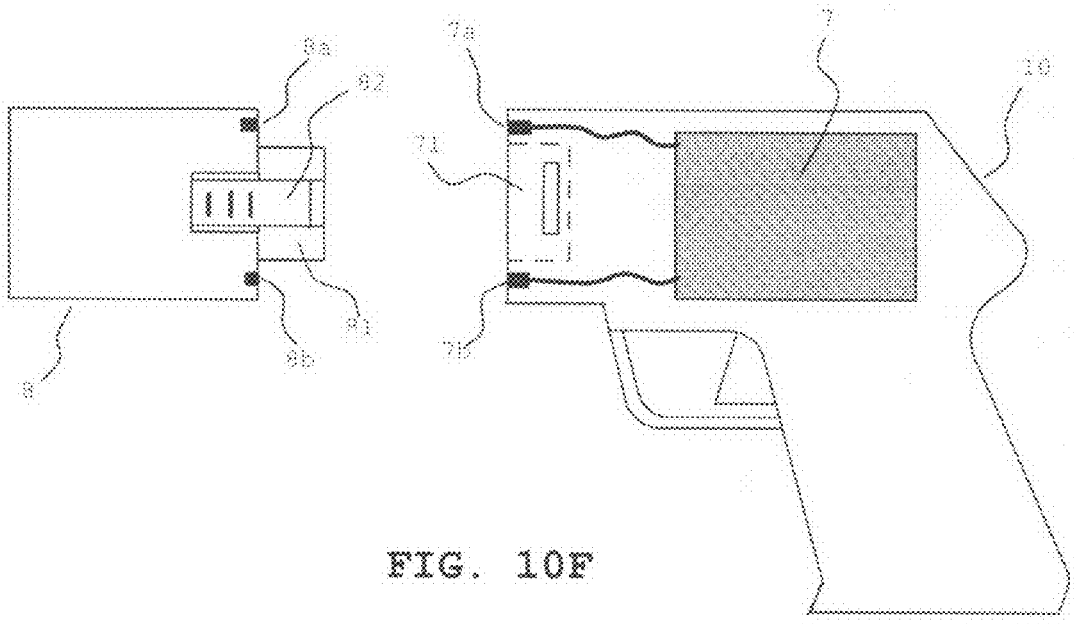
FIG. 10F illustrates the side view of an uncoupled regular stun weapon system.
Figure 10G:
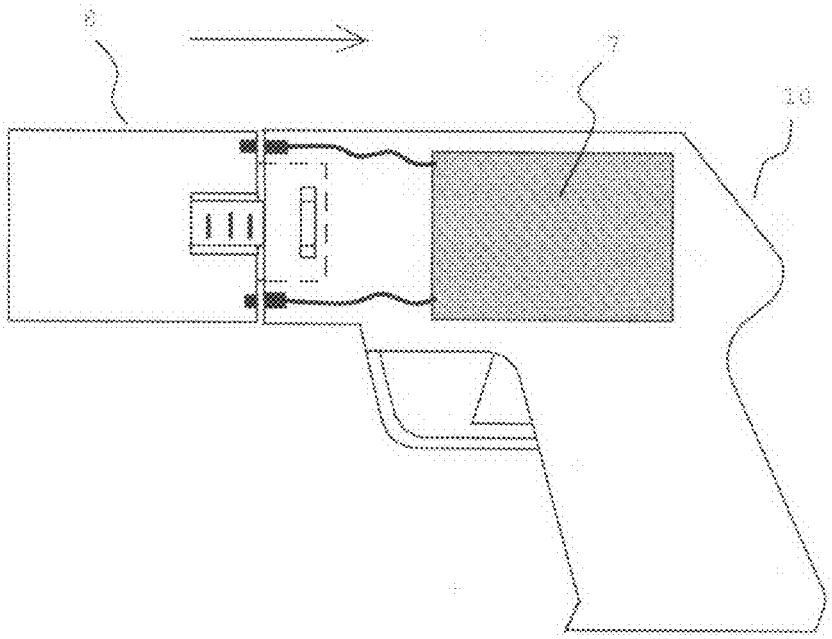
FIG. 10G illustrates the side view of a coupled regular stun weapon system.

FIG. 10A, FIG. 10B and FIG. 10C shown a regular cartridge 8, in which the cartridge is usually made in a square or rectangle shape, and having two input terminals 8*a*, 8*b*, and a smaller coupling block 81 located on the rear end, on the two rear sides also having two locking tabs 82 which can secure the cartridge to the muzzle of a stun weapon 10. As shown in FIG. 10D and FIG. 10E, a regular stun weapon 10 having a flat muzzle, the muzzle having a recess coupling hole and two output terminals 7*a* and 7*b*. To couple a cartridge 8 to the muzzle of a stun weapon 10, the user have to align the coupling block 81 to the coupling hole 71, and then insert the coupling block into the coupling hole, the cartridge is then secured with the stun weapon via the two locking tab 82.

As for the current invention, because the projectile is much longer than a regular electrode dart, and much longer trailing wires have to be stored in the cartridge. So the cartridge of the present invention is much longer than a regular stun gun cartridge. If we use the regular way of coupling, it will not be easy to align a long cartridge quickly for coupling, especially under emergency situation or in a hurry. The coupling method of the current invention must be improved to allow a user to quickly couple a long cartridge to a stun weapon.

Figure 11A:
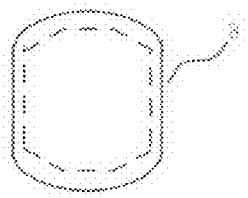
FIG. 11A illustrates the front view of a preferred cartridge.
Figure 11B:
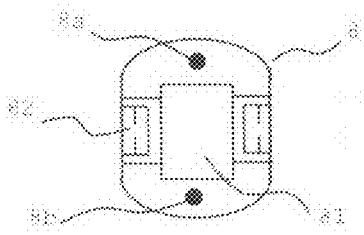
FIG. 11B illustrates the rear view of a preferred cartridge.
Figure 11C:
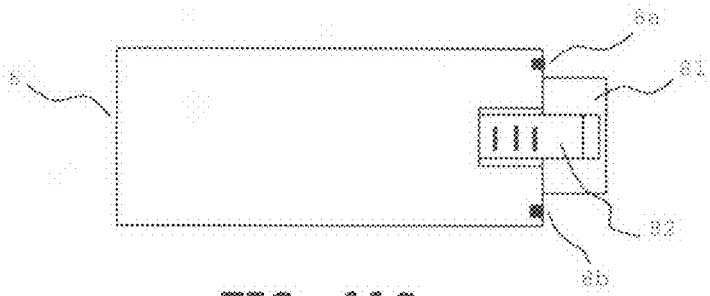
FIG. 11C illustrates the side view of a preferred cartridge.
Figure 11D:
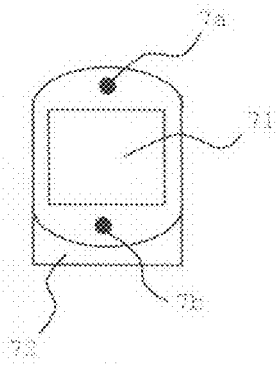
FIG. 11D illustrates the front view of a preferred stun weapon muzzle.
Figure 11E:
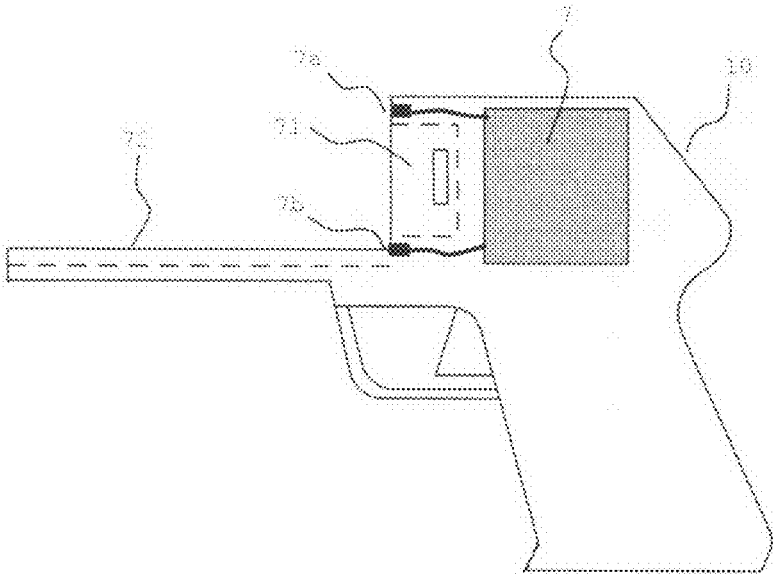
FIG. 11E illustrates the side view of a preferred stun weapon.
Figure 11F:
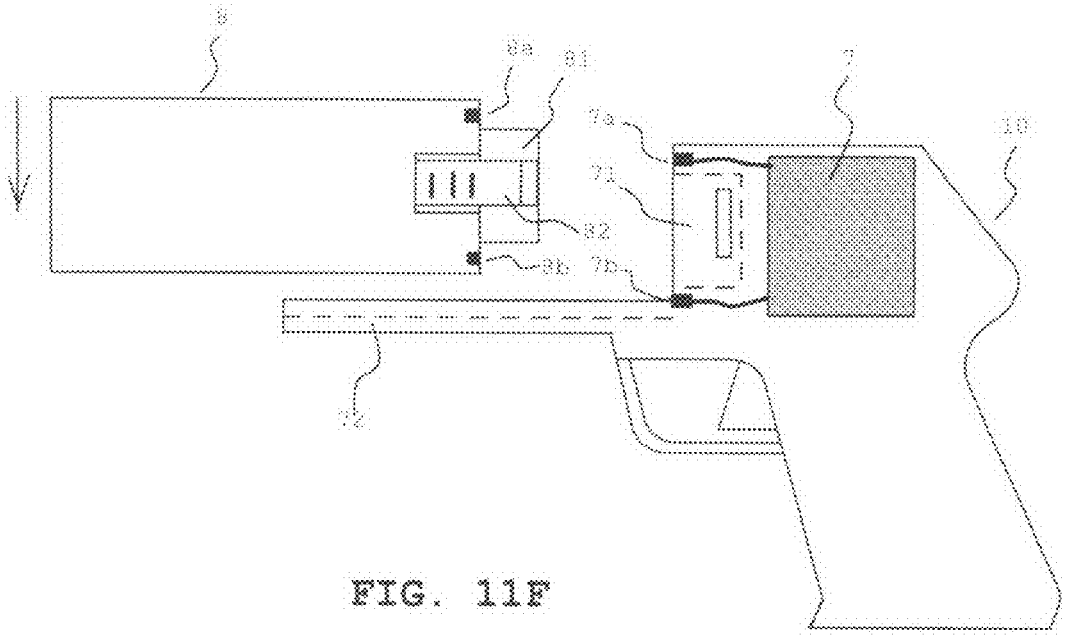
FIG. 11F illustrates the side view of an uncoupled preferred stun weapon system.
Figure 11G:
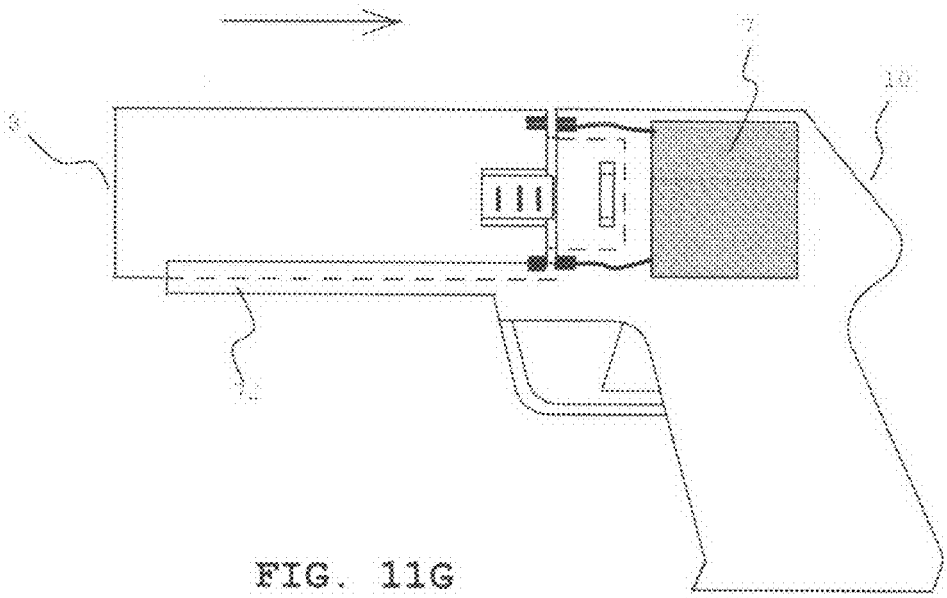
FIG. 11G illustrates the side view of a coupled preferred stun weapon system.

FIG. 11A, FIG. 11B and FIG. 11C show an improved cartridge of the present invention. On the improvement of the cartridge, instead of making the cartridge in rectangle or in square shape, the top and bottom of the cartridge are made in a projected round shape (the top and bottom are identical in size and shape, either side can be a top or bottom). FIG. 11D and FIG. 11E show an improved stun weapon of the present invention. On the improvement of the stun weapon, a long extension 72 is added to the bottom part of the stun weapon's muzzle, and the extension having a round channel on the top, the size and shape of the channel should match the size and shape of the round top or bottom of the cartridge. So, as shown in FIG. 11F and FIG. 11G, when a cartridge 8 is placed on top of a muzzle extension 72, because of the round shape, the bottom part of the cartridge is naturally guided into the channel on the extension, and the cartridge is automatically aligned for coupling, by simply pushing the cartridge backward can inserted the coupling block 81 into the coupling hole 71, and secure the cartridge to the stun weapon.

Besides a circular shape, the shape of the top and bottom of the cartridge, and the shape of the channel on the muzzle extension can be made in many other different shapes like trapezoid, corrugated, etc. as long as the cartridge can be easily placed and get aligned in the channel.

System Assembly of Preferred Embodiments

The method of assembling the preferred embodiment is illustrated in FIG. 1. First, a launching squib 3 is placed into launching chamber 13, with the outside terminals E1 and F1 of the two conducting wires E and F facing the outside. Then, a launching block 2 is placed inside barrel 1 with conductor 21*a* and 21*b* substantially closed to terminals E1 and F1. A projectile 4 is then placed inside barrel 1 with electrodes 43*a* and 43*b* slide into electrode grooves 11, the upright portion of electrode 43*a* is substantially close to conductor 21*a*, and the upright portion of electrode 43*b* is substantially close to conductor 21*b*. One end of trailing wire 5*a* is connected to electrode 43*a;* another end is connected to one output terminal of high voltage electric pulse current generator 7. One end of trailing wire 5*b* is connected to electrode 43*b*; another end is connected to another output terminal of the high voltage electric pulse current generator 7 (not shown).

Figure 7C:
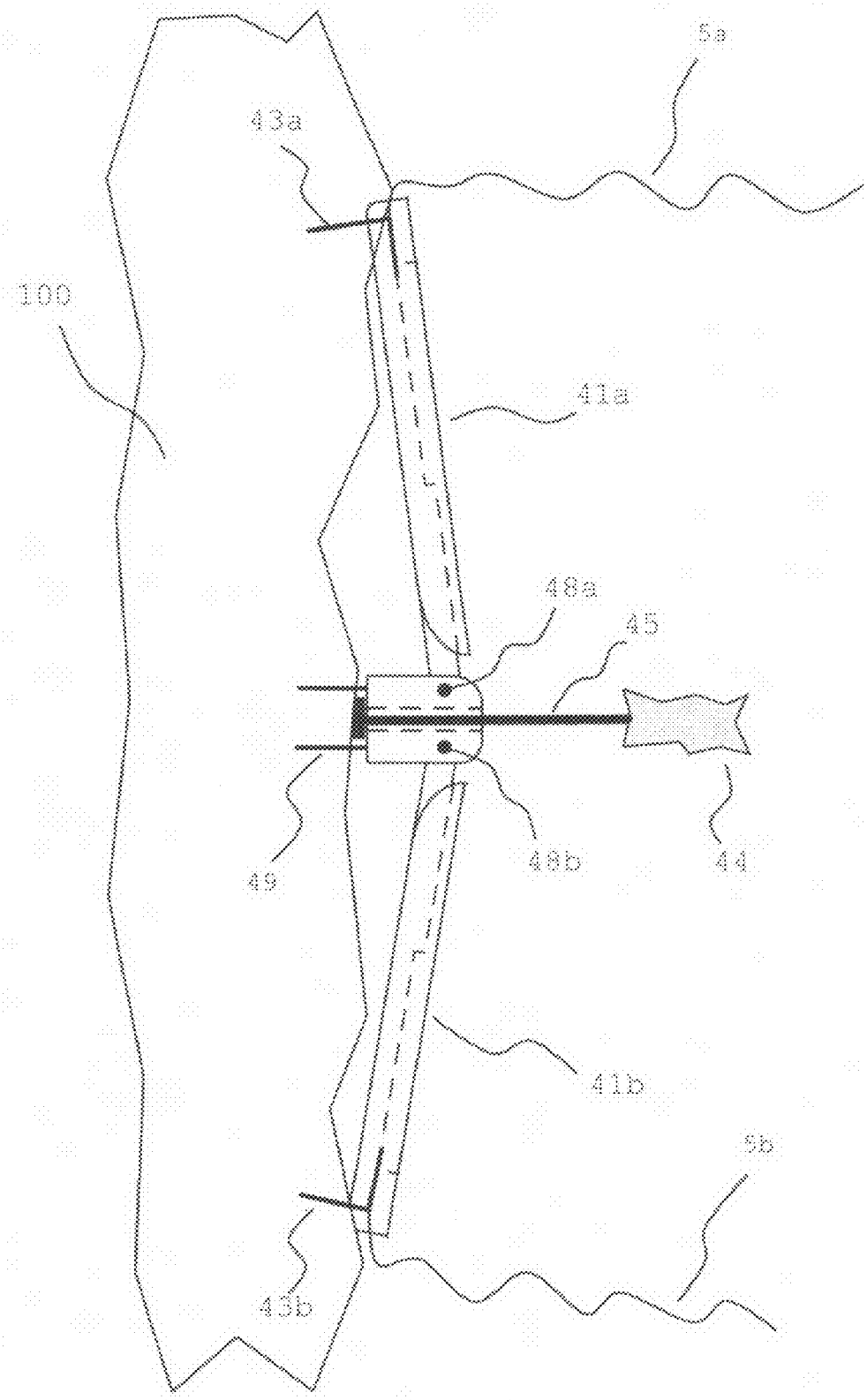
FIG. 7C illustrates the condition of a projectile with two electrodes deployed onto the target.

There are four high voltage electric pulse current paths in the whole system, each path having different resistance to the high voltage electric pulse current, refer the high voltage electric pulse current generator as Generator, the first path is Generator—5*a*-C1-21*a*-E1-E2-F2-F1-21*b*-D1-5*b*—Generator, as shown in FIG. 1, the second path is Generator—5*a*-C2-D2-5*b*—Generator, as shown in FIG. 7A, the third path is Generator—5*a*-C2-A1-A2-B2-B1-D2-5*b*—Generator as shown in FIG. 7B. The fourth path is Generator—5*a*-43*a*-target-43*b*-5*b*—Generator, as shown in FIG. 7C. The whole system must be assembled in such way that before the projectile is launched, the electric pulse current resistance of the third path is greater than that of second path, and the electric current resistance of the second path is greater than that of first path.

Operation of Preferred Embodiments

When the trigger of a stun weapon 10 is pulled, a high voltage electric pulse current is generated by the stun weapon's high voltage electric pulse current generator 7 and applied to the pointed electrodes 43*a* and 43*b* via trailing wire 5*a* and 5*b*. As describe before, because the first path has the least resistance among the four paths, the high voltage electric pulse current will complete through the first path and generate electric arcs between terminal E2 and F2 to initiate launching squib 3, and projectile 4 is then launched out of barrel 1. Once launching squib 3 is initiated and projectile 4 is launched out, the first path is destroyed, and the high voltage electric pulse current must find another path to complete the circuit. Since the second path has less resistance than the third path, during the flight of the projectile to the target, the high voltage electric pulse current will complete through the second path, and arcs through terminal C2 and D2 to complete the circuit. When projectile 4 hits target 100, as illustrated in FIG. 7B, the impact force of the projectile with the target will push detonating rod 45 backward, thus push deploying squib 44 backward and making terminals A1 and B1 getting closer to terminal C2 and D2, so the resistance of the third path is decreasing. Once the resistance of the third path is less than the resistance of second path, the high voltage electric pulse current will complete through the third path and generated electric arcs between terminal A2 and B2 and initiate deploying squib 44, the explosion of deploying squib 44 thus destroy the interlocking with the rotary arms, forces rotary arms 43*a* and 43*b* to be separated from each other and turning around hinges 48*a* and 48*b* at an arc toward the target, thus carry electrodes 43*a* and 43*b* to hit the target at a wide spread distance. Once the two electrodes 43*a* and 43*b* are in contact with the target, the high voltage electric pulse current will complete through the fourth path of Power Source—5*a*-43*a*-target-43*b*-5*b*—Power Source, as shown in FIG. 7C. The high voltage electric pulse current that pass the target from 43*a* to 43*b* will immobilize the target.

Summary, Ramification, and Scope

Accordingly, the reader will see that the system and methods for launching and deploying an electrified projectile of the present invention is different from the conventional two darts stun weapon system or the other single projectile stun weapon systems. The present invention is mainly comprised of a barrel and a projectile with two rotary arms which can rotate around hinges on the projectile head at an arc toward the target. The projectile has two pointed electrodes affixed on the rear end of the projectile. By making two electrode grooves on the barrel to accommodate these two electrodes and allow them to leave the barrel while launching can greatly simplify the mechanical structure of the projectile. The deploying squib is designed to interlock with the two rotary arms from inside before it is initiated, and release the two rotary arms for deployment after the deploying squib is initiated. The two electrodes can be deployed onto the target by the explosion of deploying squib upon the projectile hit the target. The deploying squib is initiated by the high voltage electric pulse current which is used to immobilize a human or animal target upon the projectile make impact with the target.

Although the description above contains many specificities, these should not be construed as limiting the scope of the present invention but as merely providing illustrations of some of the presently preferred embodiments of this invention. For example, the projectile can be other shapes, such as oval, rectangular, etc.; The projectile may have more than two rotary arms. The projectile can be launched by other means like compressed air, spring, etc; the high voltage electric pulse current generator can also be housed inside the projectile to make a wireless projectile system. Thus the scope of the present invention should be determined by the appended claims and their legal equivalents, rather than by the examples given.

Having thus disclosed a number of preferred embodiments of the invention, it being understood that numerous modifications and additions are contemplated and will now be apparent to those having benefit of the above disclosure, what is claimed is:

1. A long range electrified projectile immobilization system comprising:

(a) a launching device;

(b) a projectile comprising:

(1) a head having a front end, a body and a rear end; said body having a hole with one opening on said front end and one opening on said rear end; said head further comprising at least two joining means and a plurality of attaching device mounted on the face of said front end;

(2) at least two arms each having a length not less than 3 cm, each said arms having a front end and a rear end; each said arms having an exploding hole and a detonating groove; said detonating groove having one opening in said exploding hole and one opening on said front end of said arm; such that when said arms are closed up together, an exploding chamber is formed from said exploding holes, a detonating hole is formed from said hole in said head and said detonating grooves;

(3) at least two electrodes, each said electrodes having an outer terminal and an inner terminal; each said electrodes is mounted on each said rear end of each said arms with said outer terminal outside said arm and said inner terminal inside said arm; said inner terminal is exposed to said exploding hole;

(4) a detonating rod having a front end and a rear end; the length of said detonating rod is longer than said head but shorter than said projectile; the width of said detonating rod is smaller than said detonating hole, such that said detonating rod can slide inside said detonating hole;

(5) a deploying squib having a body, a front end and a rear end; said deploying squib is sensitive to electric arcs and having two conducting terminals located on said rear end; such that when a high voltage electric pulse current is applied to said conducting terminals, said deploying squib can be initiated and generate an explosion force;

wherein said front ends of said arms are attached to said head using said joining means; such that said arms can rotate around said joining means at an arc;

wherein said arms are closed up together to form a projectile having an exploding chamber and a detonating hole;

wherein said detonating rod is disposed inside said detonating hole with said front end outside said front end of said head and said rear end inside or close to said exploding chamber; such that when a force is applied to said front end of said detonating rod, said detonating rod can be pushed backward toward the rear of said projectile;

wherein said deploying squib is disposed inside said exploding chamber with said front end connect to or in close contact with said rear end of said detonating rod and with said rear end facing the rear of said projectile; said deploying squib can slide inside said exploding chamber; said deploying squib is positioned with said conducting terminals an appropriate distance away from said inner terminals of said electrodes, such that when a high voltage electric pulse current is applied to said electrodes and said deploying squib is not pushed backward toward the rear of said projectile, said high voltage electric pulse current will complete through said inner terminals of said electrodes and will not initiate said deploying squib, such that when said projectile hit a target, the impact force will push said detonating rod backward toward the rear of said projectile, causing said deploying squib to be pushed backward toward the rear of said projectile, thus causing said high voltage electric pulse current to complete through said deploying squib and initiate said deploying squib to generate an explosion force;

wherein said arms are closed up in such way that they won't separate from each other until said deploying means is initiated;

(c) a generator having at least two output terminals; said generator can generate high voltage electric pulse currents sufficient to immobilize a human or animal target;

(d) at least two conducting wires, each said conducting wire connect one of said output terminals of said high voltage electric pulse current generator to one of said electrodes on said projectile;

whereby when a high voltage electric pulse current is generated by said generator, and said projectile is propelled toward a target by said launching device and make impact with said target, said detonating rod is pushed backward by said impact, causing said deploying squib to be pushed backward toward the rear of said projectile, thus causing said high voltage electric pulse current to complete through said deploying squib and initiate said deploying squib to generate an explosion force, said explosion force will force said arms to separate from each other and rotate around said joining means at an arc to deploy said electrodes onto said target.

2. The long range electrified projectile immobilization system of claim 1 wherein said launching device comprising:

(a) a barrel comprising a bore, a top longitudinal electrode groove on the top of said bore and a bottom longitudinal electrode groove on the bottom of said bore;

(b) a propelling means having a body, a front end and a rear end; said propelling means is sensitive to electric arcs and having at least two conducting terminals located on said rear end; such that when a high voltage electric pulse current is applied to said conducting terminals, said propelling means will be initiated and generate sufficient propelling force;

(c) a launching element having a middle part, a top projection on the top of said middle part and a bottom projection on the bottom of said middle part; said middle part can fit into said bore on said barrel; said top and bottom projections can fit into said top and bottom electrode grooves on said barrel; said launching element further comprising conducting means capable of conducting high voltage electric pulse current;

wherein said propelling means is first disposed inside said barrel; said launching element is secondly disposed inside said barrel with said top and bottom projections slide into said top and bottom electrode grooves on said barrel and with said conducting means substantially close to said conducting terminals of said propelling means; such that when a projectile having electrodes is disposed inside said barrel and with said electrodes substantially closed to said conducting means, a high voltage electric pulse current applied to said electrodes will be conducted to said conducting terminals of said propelling means via said conducting means and initiate said propelling means to propel said projectile out of said barrel.

3. The launching device of claim 2 wherein said barrel is composed of non-conductive material.

4. The launching device of claim 2 wherein said launching element is composed of non-conductive material.

5. The two arms of claim 1 wherein each said exploding hole further having at least one longitudinal groove located on the sides of said exploding hole; wherein said body further having at least two projections in locations and orientations corresponding to said grooves on said exploding hole;

wherein when said two arms are closed up together to form a projectile having an exploding chamber, said exploding chamber will have at least two grooves on the sides of said exploding chamber;

wherein when said deploying squib is disposed inside said exploding chamber with said projections on said body slide into said grooves on said exploding chamber; said deploying squib will interlock with said arms from the inside of said projectile through the relationship of said projections with said grooves; such that said two arms can not be separated from each other until said deploying squib is removed from said projectile or is destroyed into pieces.

* * * * *